United States Patent [19]

McReynolds

[11] 4,425,085

[45] Jan. 10, 1984

[54] CHECK VALVE ARRANGEMENT FOR ENGINE DRIVEN PNEUMATIC COMPRESSORS

[76] Inventor: James McReynolds, 1425 College Way, Apt. 401, Olathe, Kans. 66061

[21] Appl. No.: 377,988

[22] Filed: May 13, 1982

[51] Int. Cl.[3] ..... F04B 17/00

[52] U.S. Cl. ..... 417/364

[58] Field of Search ..... 417/362, 364, 380; 60/307; 137/515.3, 515.5, 533.13, 533.15

[56] References Cited

U.S. PATENT DOCUMENTS

| | | | |
|---|---|---|---|
| 1,025,977 | 5/1912 | Henderson | 137/515.3 |
| 1,597,088 | 8/1926 | McCracken | 137/533.13 |
| 2,628,015 | 2/1953 | Neugebauer et al. | 417/380 |
| 3,204,859 | 9/1965 | Crooks | 417/380 |
| 3,688,859 | 9/1972 | Hudspeth et al. | 417/233 |
| 4,355,959 | 10/1982 | Kono et al. | 417/233 |

*Primary Examiner*—Carlton R. Croyle
*Assistant Examiner*—Timothy S. Thorpe
*Attorney, Agent, or Firm*—Litman, Day & McMahon

[57] ABSTRACT

A check valve is positioned in the pneumatic power system of a vehicle in which air is supplied to a pneumatic compressor from an induction manifold of an engine. The compressor has an oil sump, a start and stop clutch, an air inlet, and an air outlet. A check valve is emplaced in the air inlet conduit leading from the engine manifold to the compressor to provide a one-way flow of air into the compressor when the compressor is running and to block the conduit in response to a vacuum created therein and prevent the vacuum from reaching the compressor when the compressor is not running. The valve prevents oil from the compressor sump from being drawn into the pneumatic system and fouling air actuated devices.

5 Claims, 4 Drawing Figures

Fig. 1.
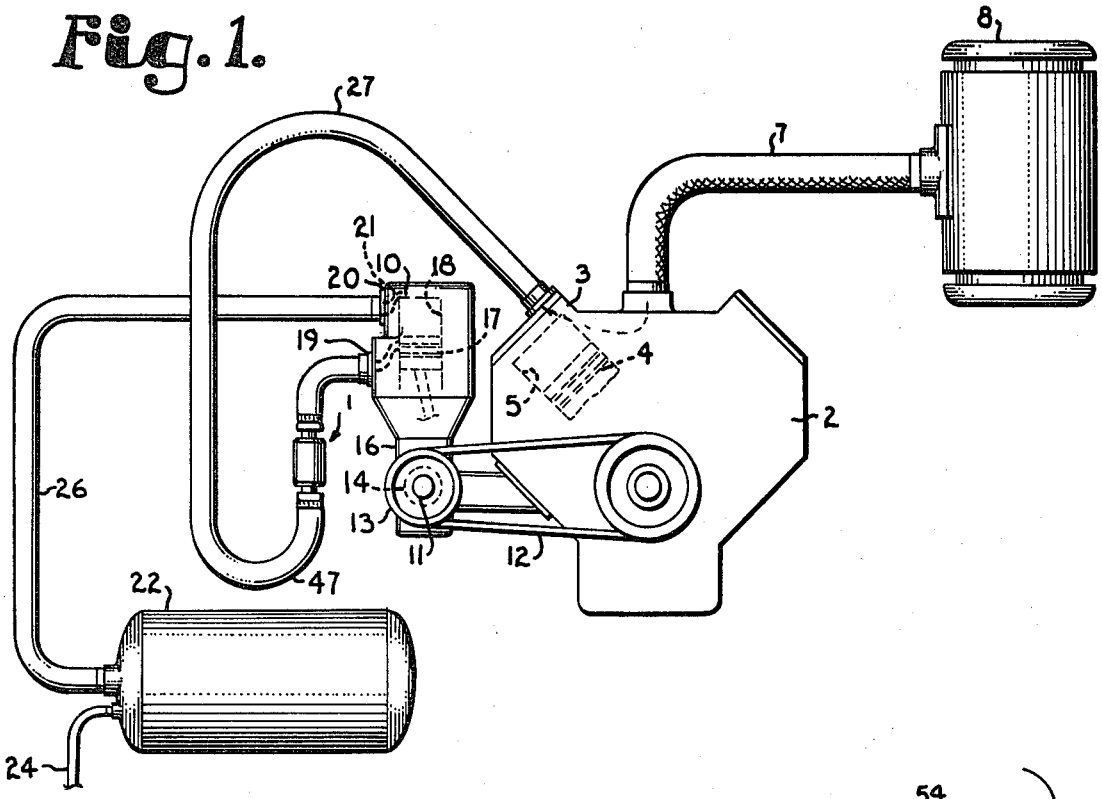
Fig. 2.
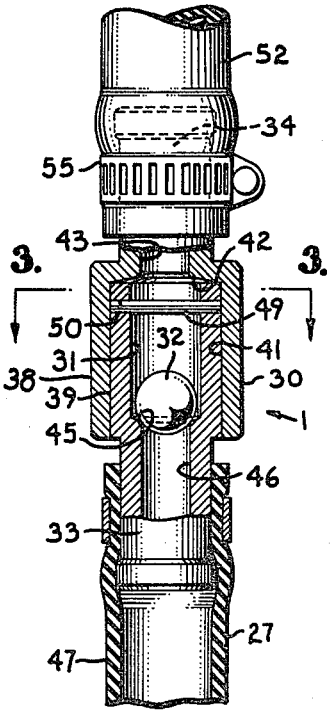
Fig. 3.
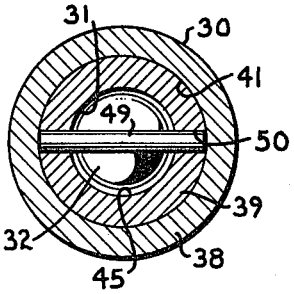
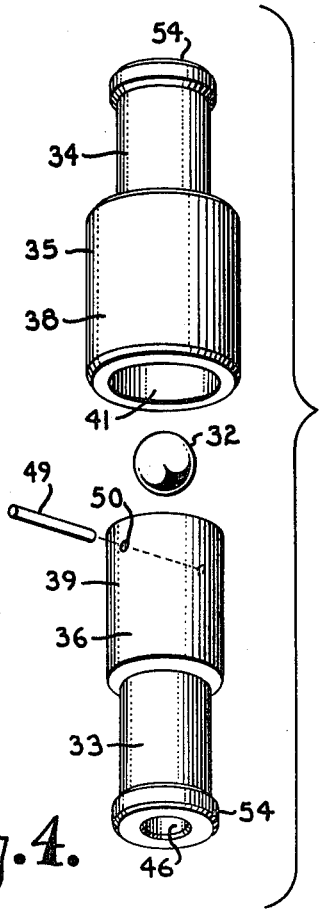
Fig. 4.

CHECK VALVE ARRANGEMENT FOR ENGINE DRIVEN PNEUMATIC COMPRESSORS

This invention relates to pneumatic power systems, and in particular, to such a power system in which a compressor receives intake air from an engine.

BACKGROUND OF THE INVENTION

In the usual pneumatic power system of a vehicle, such as a truck having air actuated brakes and other devices, a pneumatic compressor is driven by belts extending from the truck engine and has a selectively engageable clutch actuated by a pressure sensing switch. When the power demand is high, such as during braking operations, the compressor runs and provides pressurized air to a reservoir or holding tank. When the pressure in the tank falls below a certain limit, such as 120 pounds, the pressure sensitive switch causes the clutch to engage and the compressor to start operation.

Normally, the air intake line for the compressor is connected to the engine air induction manifold through which air is drawn into the engine cylinders during downstrokes of the pistons. A substantial vacuum or negative pressure is created in the induction manifold and during operation of the compressor, air is further drawn from the manifold. The air first travels through a filter for cleaning and is then normally compressed in some manner, such as by turbo charging or supercharging prior to entering the induction manifold.

As long as the compressor is also drawing or pulling air through the induction manifold, operation of the pneumatic power system remains satisfactory; however, when the compressor shuts off for any reason, such as sufficient tank pressure, the drawing power of the engine pistons tend to pull a vacuum or create a negative pressure in the compressor inlet conduit. This negative pressure also reaches the internal compression means of the compressor, such as a rotor or pistons, and tends to create a negative pressure in the compression chambers, pulling oil upwardly from the compressor oil sump wherein the oil tends to accumulate in the chambers. When the compressor again commences operation, the mixture of oil and pressurized air tends to be pushed into the reservoir or tank and from there into the air actuated devices, such as the brakes. This contamination can be very dangerous and in many cases can lead to brake failure with resultant injuries to life and property.

The present invention provides a check valve in the intake line to break or interrupt the accumulation of vacuum pressure in the line from reaching the compressor, thereby preventing the vacuum drawing of oil into the compressor chambers. The valve is readily installed in existing pneumatic power systems and is sufficiently inexpensive to make such a retrofit economical.

OBJECTS OF THE INVENTION

The principal objects of the present invention are: to provide a valve arrangement for pneumatic power systems; to provide such a valve arrangement which blocks the entrance of oil to the reservoir or tank and to air actuated devices; to provide such a valve which is effective in operation and substantially trouble free; to provide such a valve which is easy to install and retrofit into existing pneumatic power systems; and to provide such a valve which is readily inexpensive to manufacture and purchase.

Other objects and advantages of this invention will become apparent from the following description taken in conjunction with the accompanying drawings wherein are set forth, by way of illustration and example, certain embodiments of this invention.

Description of the Drawings

FIG. 1 is a diagramatic view of a pneumatic power system including a valve arrangement embodying the present invention.

FIG. 2 is an enlarged, fragmentary, elevational view of the valve arrangement.

FIG. 3 is a transverse sectional view of the valve arrangement taken along lines 3—3, FIG. 2.

FIG. 4 is a disassembled view of the valve arrangement.

Description of the Preferred Embodiment

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally indicates a valve arrangement embodying the present invention. The valve 1 comprises a check valve for use in the air inlet conduit of a pneumatic compressor to provide one-way flow of air into the compressor when the compressor is running and to block the conduit in response to vacuum therein and prevent the vacuum from reaching the compressor when the compressor is not running, thereby preventing drawing of oil into the pneumatic lines.

The valve 1 is used in conjunction with a pneumatic power system for a vehicle which, in the illustrated example, includes a vehicle engine 2 having an air induction manifold 3 into which air is normally drawn. The engine 2 includes the typical internal arrangement of pistons 4 which travel within cylinders 5 and upon down stroke, create a substantial vacuum in the manifold 3. Further, air is supplied to the manifold 3 through an intake line 7 and cleaned by an air filter 8. In many vehicles, a turbo charger or supercharger (not shown) is mounted in the intake line 7 to provide ram or pressurized air to the induction manifold 3.

A pneumatic compressor 10 is associated with the engine 2, such as by mounting thereto, and is driven by the engine. In the illustrated example, the compressor 2 has a main shaft 11 rotated by a belt 12 driven by the engine. The belt 12 connects to a pulley 13 on the compressor through a clutch arrangement 14. In use, the clutch 14 is selectively engaged and disengaged to cause intermittent operation of the compressor 10 in order to maintain a desired operating pressure for the system. The compressor 10 also includes an oil sump 16, internal compression means, such as a piston 17 traveling within a compression chamber or cylinder 18, an air inlet 19 and an air outlet 20. The inlet and outlet 19 and 20 are connected to internal passageways 21 of the compression chamber or cylinder 18 and are operable to respectively admit air to the chamber cylinder 18 and route pressurized air from the cylinder.

A reservoir or tank 22 is provided for storing the compressed air and is connected to various air actuated devices, such as air brakes (not shown) via air conduits 24.

An air outlet conduit 26 extends from and communicates the compressor air outlet 20 with the reservoir or tank 22.

An air inlet conduit 27 extends from and communicates the compressor air inlet 19 with the engine manifold 3. In use, the compressor 10 draws air through the inlet conduit 27 when the compressor is running. When the compressor 10 is not running, as by disengagement of the clutch 14, the engine 2 tends to draw air from the inlet conduit 27 and creates a vacuum or negative pressure in the conduit 27.

Heretofore, the negative pressure in the inlet conduit 27 tended to also create a negative pressure in the compression chamber or cylinder 18. This negative pressure tended to draw oil upwardly from the sump 16 past the rings or seals of the pistons 17 or beyond the roller (not shown) if the compressor was the rotary type. The oil accumulated in the chamber cylinder 18 and when the clutch 14 again engaged and the compressor 10 started, the oil would be forced through the outlet conduit 26 and into the reservoir or tank 22. As the oil is generally not compressible, the oil tended to accumulate within the reservoir or tank 22 and occupy volume needed to supply a quantity of pressurized air for braking purposes and for use by other air actuated devices. In many cases, the oil tended to flow out of the reservoir or tank 22 and through the air conduits 24 to the particular devices, accumulating in the brakes or the devices. A safety hazard occurs when the oil accumulates in or contaminates the brakes and may lead to loss of braking power and resulting dangers to life and property. In other cases, the oil can completely clog fine passageways and cause the devices to work improperly, if at all.

The valve arrangement 1 is positioned, as described below, in the air inlet conduit 27 and is operable to provide a one-way flow of air into the compressor 10 when the compressor is running. The valve 1 has internal valve means operable to block the conduit 27 in response to vacuum therein and prevent the vacuum from reaching the compressor 10 when the compressor is not running, thereby preventing oil from being drawn from the sump 16 and into the outlet conduit 26, reservoir or tank 22 and air conduits 24.

In the illustrated example, the valve arrangement 1 includes a body 30 having an internal chamber 31 housing a check means 32 therein and having inlet and outlet male ends or projections 33 and 34. In the illustrated example, the valve arrangement 1 is constructed in two parts, FIG. 4, comprising a first portion 35 and a second portion 36 with the first portion 35 having the outlet projection 34 thereon and the second portion 36 having the inlet projection 33. The first and second portions 35 and 36 each include wall means providing respective cups 38 and 39 each having a longitudinal bore therein forming respective chambers. The cup 38 has a chamber 41 sized for receipt of the cup 39 and the cup 39 has the inner chamber 31 therein which receives the check means 32. An annular shoulder 42 is formed at the inner termination of the larger chamber 41 wherein the chamber 41 joins a through bore 43 extending from the outlet projection 34 to provide an outlet port. An annular shoulder 35 is formed at the interior termination of the chamber 31 wherein the chamber 31 communicates with a through bore 46 extending from the inlet projection 33 to provide an inlet port. In the illustrated example, the check means 32 is a ball and the inner shoulder 45 forms a valve seat for receipt of the ball 42 wherein the ball presses tightly against the seat upon the application of vacuum to a first portion 47 of the inlet line 27 leading to the engine 2 and tightly closes the bore 46. In order to prevent the ball 32 from the moving upwardly and seating against the shoulder 42 to close the bore 43, a restriction is placed within the chamber 31. In the illustrated example, the restriction consists of a rod 49 extending transversely across an upper portion of the chamber 31 and through aligned bores 50 in the wall of the cup 39 and spaced from the shoulder 42.

The air inlet conduit 27 is preferably formed of a length of flexible hose material and, with the placement of the valve arrangement 1, is divided into the portion 47, leading from the inlet projection 33 of the valve arrangement 1 to the air induction manifold 3, and a second portion 52 leading from the outlet projection 34 to the pressure air inlet 19. For ease of securement to the flexible hose, the projections 33 and 34 each include outer ends having flanges or an annular rib 54 thereon. For connection to the air inlet conduit 27, the flexible hose is cut to form a substantially upright loop portion and the valve arrangement 1 fitted onto the cut ends and positioned in as much of an upright relationship as possible. Hose clamps 55 are fitted onto the respective projections 33 and 34 to secure the cut ends of the conduit to the valve.

The valve arrangement 1 is positioned in the relationship shown in FIG. 2, wherein the internal valve means permits passage of air from the air induction manifold 3 into the compressor 10 but does not permit substantial passage of air in the opposite direction. In the particular valve arrangement shown in FIG. 2, the air coursing inwardly from the induction manifold 3 to the compressor 10 must be of sufficient pressure to overcome the weight of the ball 32 and be drawn around the ball and through the chamber 31 to reach the compressor 10. When the compressor 10 is no longer drawing air inwardly, as when the clutch arrangement 14 disengages, the induction manifold 3 tends to draw air through the inlet conduit 27 in the reverse direction, evacuating the air in the conduit or hose first portion 47 and causing a ball 32 to seal more tightly onto the seat 45. Thus, while substantial vacuum may be created in the conduit first portion 47, the vacuum is prevented from entry into the conduit second portion 52 and from reaching the compressor 10. The weight of the ball 32 is sufficient to cause the ball to engage the seat 45 at any major drop in incoming air pressure, thereby preventing even a small amount of vacuum pressure from reaching the compressor 10.

It is to be understood that while certain forms of the present invention have been illustrated and described herein, it is not to be limited to the specific forms or arrangement of parts described and shown.

What is claimed and desired to secure by Letters Patent is as follows:

1. A pneumatic power system comprising:

(a) an engine having an air induction manifold into which air is drawn;

(b) a pneumatic compressor associated with said engine and having an oil sump, internal compression means, start and stop means, an air inlet and an air outlet;

(c) an air outlet conduit extending from and communicating said air outlet with air actuated devices;

(d) an air inlet conduit extending from and communicating said compressor air inlet with said engine manifold, said compressor drawing air through said inlet conduit when said compressor is running and said engine drawing air and creating a vacuum in said inlet conduit when said compressor is not running; and (e) a one-way check valve in said air inlet conduit operable to provide one-way flow of air into said compressor when said compressor is running and having valve means blocking said conduit in response to vacuum therein and prevent said vacuum from reaching said compressor when said compressor is not running.

2. The system set forth in claim 1 wherein:

(a) said check valve includes a valve body having a chamber therein and with means defining inlet and outlet ports with said inlet port leading to said manifold and said outlet port leading to said compressor;

(b) a ball received in said chamber;

(c) a valve seat at said inlet port to seat said ball; and (d) means preventing said ball from seating against said outlet port.

3. The system set forth in claim 2 wherein:

(a) said check valve is elongate and oriented in an upright relationship;

(b) said inlet port is at a lower end; and (c) said outlet port is at an upper end.

4. The system set forth in claim 1 wherein:

(a) said check valve includes a first tubular member and a second tubular member;

(b) said first and said second tubular members have wall means forming an elongate chamber;

(c) a ball is received within said chamber;

(d) said wall means of said first tubular member is telescopically received with said wall means of said second tubular member.

5. A pneumatic power system for a vehicle comprising:

(a) a vehicle engine having an air induction manifold into which air is normally drawn;

(b) a pneumatic compressor mounted to said vehicle and driven by said engine; said compressor having an oil sump, internal compression means, start and stop means, an air inlet and an air outlet;

(c) a reservoir for storing compressed air and connected to air actuated devices via air conduits;

(d) an air outlet conduit extending from and communicating said compressor air outlet with said reservoir;

(e) an air inlet conduit extending from and communicating said compressor air outlet with said engine manifold, said compressor drawing air through said inlet conduit when said compressor is running and said engine tending to draw air from said inlet conduit when said compressor is not running, thereby creating a vacuum therein; and (f) a one-way check valve in said air inlet conduit operable to provide one-way flow of air into said compressor when said compressor is running and having valve means operable to block said conduit in response to vacuum therein and prevent said vacuum from reaching said compressor when said compressor is not running.

* * * * *